US006832700B2

(12) United States Patent
Roberts et al.

(10) Patent No.: US 6,832,700 B2
(45) Date of Patent: Dec. 21, 2004

(54) TOGGLE-ACTION DISPENSING CLOSURE WITH AN ACTUATION-PREVENTION SYSTEM INCORPORATING PERMANENT DEFORMATION

(75) Inventors: Charles E. Roberts, Eagle, WI (US); Terry J. Vandenboom, Kansasville, WI (US); Nicholas J. Jelich, Oconomowoc, WI (US); Catherine F. Schultz, Eagle, WI (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 10 days.

(21) Appl. No.: 10/369,082

(22) Filed: Feb. 18, 2003

(65) Prior Publication Data

US 2004/0159684 A1 Aug. 19, 2004

(51) Int. Cl.[7] ..... B67B 5/00
(52) U.S. Cl. ..... 222/153.14; 222/546
(58) Field of Search ..... 222/153.14, 546, 222/556

(56) References Cited

U.S. PATENT DOCUMENTS

| | | | |
|---|---|---|---|
| 3,516,581 | A | 6/1970 | Micallef |
| 4,776,501 | A | 10/1988 | Ostrowsky |
| 4,962,869 | A | 10/1990 | Gross et al. |
| 5,058,775 | A | 10/1991 | Gross et al. |
| 5,279,451 | A | 1/1994 | Mueller et al. |
| 5,284,264 | A | 2/1994 | Gross |
| 5,314,093 | A | 5/1994 | Gross et al. |
| 5,341,960 | A | 8/1994 | Lay |
| 5,346,100 | A | 9/1994 | Lay |
| 5,379,926 | A | 1/1995 | Mueller et al. |
| 5,579,961 | A | 12/1996 | Zimmerman |
| 5,709,318 | A | 1/1998 | Oder |
| 5,862,963 | A | 1/1999 | Fuchs et al. |
| 6,029,866 | A | 2/2000 | Wood et al. |
| 6,283,333 | B1 | 9/2001 | Knickerbocker et al. |
| 6,343,725 | B1 * | 2/2002 | Lohrman ..... 222/536 |

* cited by examiner

*Primary Examiner*—Joseph A. Kaufman
(74) *Attorney, Agent, or Firm*—Wood, Phillips, Katz, Clark & Mortimer

(57) ABSTRACT

A toggle-action dispensing closure for a container is provided for manipulation between a closed, non-dispensing orientation and an open, dispensing orientation. The closure includes an actuator pivotally mounted along a tilting axis on a body secured to the container. The actuator is tiltable by applying force to the actuator on one side of the tilting axis so as to move the actuator from a non-dispensing position to a dispensing position. The actuator includes a flange having an engagable surface. The closure body includes an annular wall in which the actuator is received, and the annular wall includes an inwardly projecting interference member which underlies the actuator engagable surface and prevents tilting of the actuator unless a sufficient predetermined, initial opening force is exerted on the actuator to cause permanent, plastic deformation of the engagable surface is and/or interference member. Thereafter, the actuator can be tilted to the open dispensing position a second or subsequent times in response to subjecting the actuator to a force less than the predetermined, initial opening force.

6 Claims, 9 Drawing Sheets

TOGGLE-ACTION DISPENSING CLOSURE WITH AN ACTUATION-PREVENTION SYSTEM INCORPORATING PERMANENT DEFORMATION

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a toggle-action dispensing closure for a container, wherein the closure can be manipulated between a closed orientation and an open, dispensing orientation.

BACKGROUND OF THE INVENTION AND TECHNICAL PROBLEMS POSED BY THE PRIOR ART

Designs have been proposed for containers used with flowable substances wherein a closure is provided for being attached to the container mouth and wherein the closure includes a toggle-action actuator, flip-up spout, or nozzle assembly for dispensing the container contents. See, for example, U.S. Pat. Nos. 6,283,333; 5,346,100; 5,058,775; 4,962,869; 4,776,501; 4,645,086 and 3,516,581.

The toggle-action closures, such as those disclosed in the above-referenced U.S. Pat. Nos. 6,283,333; 5,346,100, 5,058,775, 4,962,869, and 4,776,501, require that the operator push down on a top, rear portion of the closure in order to pivot the actuator of the closure to the dispensing orientation.

When the actuator is pivoted to the dispensing orientation, a discharge passage in the actuator is in communication with the container contents, and the container contents can flow out through the actuator. Typically, such toggle-action closures are provided on squeezable containers fabricated from a thermoplastic material providing a inwardly deformable, resilient wall structure. When the container wall structure is squeezed, the contents within the container are forced upwardly and out through the open dispensing closure.

It has also been found that toggle-action closures can present problems when using automatic equipment to initially apply the closure to a container. Typically, modern container filling and closure-applying processes employ conveying systems in which containers are moved seriatim and filled with the product prior to a closure being applied to each of the filled containers. After a container has been filled with the product, the filled container is typically moved to a capping station where a capping machine automatically applies the closure.

The capping machine typically receives toggle-action dispensing closures fed to it from a supply of such closures which have been previously assembled so that each actuator is in the closed, non-dispensing position on the closure body.

Typically, a closure manufacturer makes and assembles the closure body and actuator at a facility remote from the container filling and capping facility. The toggle-action dispensing closures, each comprising an assembled closure body and actuator in the closed position, are typically shipped in bulk to the container filling and capping facility. During such shipment, one or more of the toggle-action dispensing closures may be bumped or impacted in such a way that the actuator moves to a partly open or completely open, dispensing position on the closure body. After the toggle-action dispensing closures are received by the container filling and capping facility, the toggle-action dispensing closures are fed to the automatic capping machines. If an actuator of a toggle-actuating dispensing closure has been accidentally bumped and moved to a partly open, or completely open position, then that closure may become lodged, or otherwise stuck, in the equipment that feeds the closures to the automatic capping machine, or that open closure may become stuck in the automatic capping machine itself. This can cause production down time and loss owing to the necessity for stopping the automatic cap-applying process in order to permit the problem to be remedied.

During subsequent shipping and handling of a filled container capped with a closed toggle-action closure, the toggle-action closure may be accidentally bumped or impacted in a way that causes the actuator to pivot to the partly open, or completely open, dispensing orientation. It is then possible for the contents to be accidentally discharged. If the container is lying on its side, the contents can leak out of the accidentally opened closure. If the container is upright in a carton, the carton may be subjected to rough handling causing the wall of the container to be temporarily squeezed inwardly and causing an unwanted discharge of a portion of the container contents through the open closure (resulting in leakage or spillage).

In order to eliminate, or substantially minimize, the potential for premature opening of a toggle-action closure during automatic capping processes and/or during shipping and handling of filled containers capped with toggle-action closures, the toggle-action closure of the type disclosed in the above-referenced U.S. Pat. No. 4,962,869 was developed. This closure has effectively solved a long-felt need to prevent inadvertent discharge through toggle-action closures during capping processes, shipping, and handling.

The closure disclosed in the U.S. Pat. No. 4,962,869 provides a unique structure which prevents or greatly inhibits the opening of the toggle-action actuator during capping processes, shipping, and handling. In particular, the closure body is provided with an upstanding abutment or resistance post under a rear portion of the toggle-action actuator. The actuator includes a shearing wall for confronting the abutment post when the actuator is initially closed in the non-dispensing position. When a moderate force is applied to the rear of the actuator, the actuator will not tilt upwardly to the open position because the shearing wall engages the abutment.

The abutment is designed to withstand the forces typically encountered during automatic capping processes, during shipping, and during handling. However, the abutment is designed to be sheared off when the actuator is subjected to at least a predetermined force greater than the forces typically encountered during capping processes, shipping, and handling. When the consumer uses the closure for the first time, the consumer must apply, to the rear of the actuator, a force at least equal to the predetermined force so as to cause the shearing wall to shear off the abutment. Thereafter, the consumer can subsequently open the actuator by applying a much lower force.

U.S. Pat. Nos. 5,346,100 and 6,283,333 describe further improved toggle-action dispensing closures provided for manipulation between a closed, non-dispensing orientation and an open, dispensing orientation. The closures include an actuator mounted on a body that can be secured to the container. The body has an angled control surface at the base of an abutment which is broken by a shearing wall of the actuator. The control surface influences the fracture of the abutment from the control surface through the abutment. With this surface, the fracture is more likely to occur within a predetermined narrow range of forces applied to the actuator.

The above-discussed closure designs disclosed in U.S. Pat. Nos. 4,962,869, 5,346,100, and 6,283,333 function well and satisfy the objectives of preventing or inhibiting leakage during capping processes, during shipping, and during handling. However, the present inventors have recognized that it is difficult to design and mold the abutment so that it will reliably always shear off completely when the abutment is subjected to a predetermined shearing force, and that the required shear force may vary somewhat from closure to closure. Also, the molding of a closure with such an abutment design is somewhat complicated, in part because the mold assembly typically employs at least one mold insert.

The present inventors have recognized that it would be desirable to provide an improved design which would not require breaking of an abutment, which would be more reliable, and which would have lower design and manufacturing costs.

SUMMARY OF THE INVENTION

The toggle-action dispensing closure structure of the present invention includes a closure body that can be mounted to, or formed with, a container, and a pivotable actuator mounted on the closure body.

The closure body can be adapted for extending from, or otherwise engaging, the container over the opening in the container. The closure body defines a discharge aperture communicating with the container opening.

The actuator is pivotally mounted in the body on a tilting axis, and the actuator occludes the discharge aperture to prevent flow from the container when the actuator is in a closed, non-dispensing position. The actuator permits flow from the container when sufficient force is applied to the actuator to pivot or tilt the actuator to an open, dispensing position.

The improved system of the invention prevents, or reduces the likelihood of, an inadvertent, premature opening or actuation of the closure to the dispensing position during capping processes, during shipping, and during handling. The improved system operates more reliably, and can be incorporated in structures that can be produced with simpler and lower cost manufacturing techniques.

The invention provides an improved, premature actuation-prevention system for preventing pivoting of the actuator to open the closure unless a sufficient force is initially exerted on the actuator to overcome interference between portions of the structure. Specifically, before the improved closure structure can be opened for the first time by the consumer, the user must initially subject the actuator to a significantly greater-than-normal force.

Either the closure body or the actuator has an interference member projecting adjacent a portion of the other of the body and actuator. The other of the body and actuator has an engagable surface for effecting an engagement of the interference member as the actuator moves from the closed, non-dispensing position toward the open position. The engagement initially prevents tilting of the actuator to the open position in response to the actuator being subjected to a force less than a predetermined force.

However, when the actuator is subjected for the first time to a force equal to or greater than the predetermined force, the engagement results in a permanent, plastic deformation of at least either the interference member or the engagable surface so that the actuator can tilt to the open dispensing position.

Thereafter, the actuator can be returned to the closed, non-dispensing position. Subsequently, the actuator can be tilted back to the open position—but the amount of force required for such subsequent tilting of the actuator to the open dispensing position is less than the minimum (predetermined) force that must be initially applied to the actuator to initially tilt the actuator to the open, dispensing position for the first time.

The improved dispensing closure structure of the present invention thus provides an initial, higher opening force that resists opening when the actuator is subjected to impacts during capping processes, shipping, and/or handling prior to delivery to the ultimate user.

Additionally, the improved dispensing closure structure provides a way to control the amount of force necessary to open the closure, both initially for the first time, and during all subsequent openings of the closure after the first time the closure is opened.

The toggle-action dispensing closure of the present invention is especially suitable for being mounted over, or formed on, the opening in a container, especially a container of the type having a generally flexible wall portion which can be squeezed to assist in dispensing the contents from the container.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

DESCRIPTION OF THE PREFERRED EMBODIMENT

While this invention is susceptible of embodiment in many different forms, this specification and the accompanying drawings disclose only one specific form as an example of the invention. The invention is not intended to be limited to the embodiment so described, however. The scope of the invention is pointed out in the appended claims.

For ease of description, the closure system or structure of this invention is described in an upright position, and terms such as upper, lower, horizontal, etc., are used with reference to this position. It will be understood, however, that the closure structure of this invention may be manufactured, stored, transported, used, and sold in an orientation other than the position described.

Figure 1:
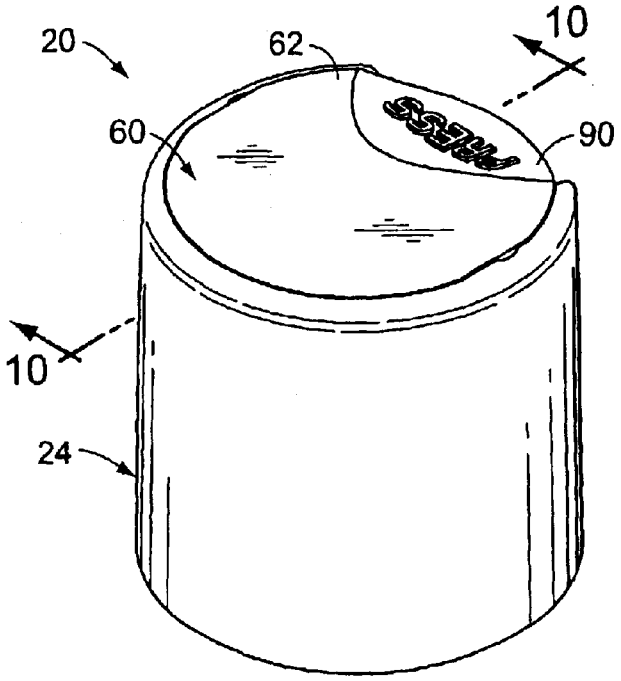
FIG. 1 is a perspective view of a toggle-action dispensing closure structure, in the preferred form of a separate closure per se adapted to be mounted to a container, and the closure is shown in an initially closed, non-dispensing condition prior to installation on a container.
Figure 2:
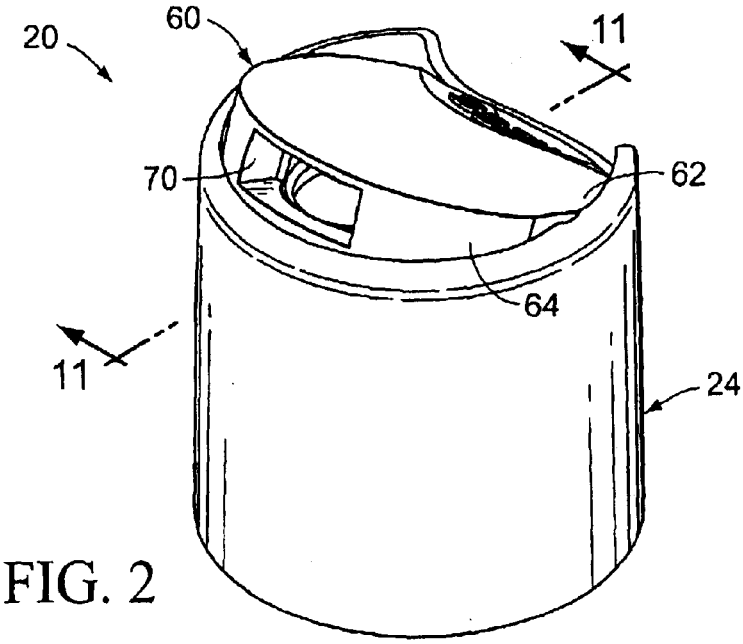
FIG. 2 is a view similar to FIG. 1, but FIG. 2 shows the closure with the actuator tilted to an open, dispensing position.

FIGS. 1 and 2 show an assembled embodiment of the dispensing closure structure of the present invention in the form of a separate closure per se. In this embodiment, the closure is illustrated in a closed, non-dispensing condition and is designated generally by reference number 20. The closure 20 is adapted to be mounted on a container (not illustrated) which may have a conventional open mouth defined by a neck (not illustrated) or other suitable structure. Alternatively, at least part of the closure could be formed unitarily with a container. In either case, the container may advantageously be of the type having a generally flexible wall portion which can be squeezed to assist in dispensing the contents from the container.

Figure 3:
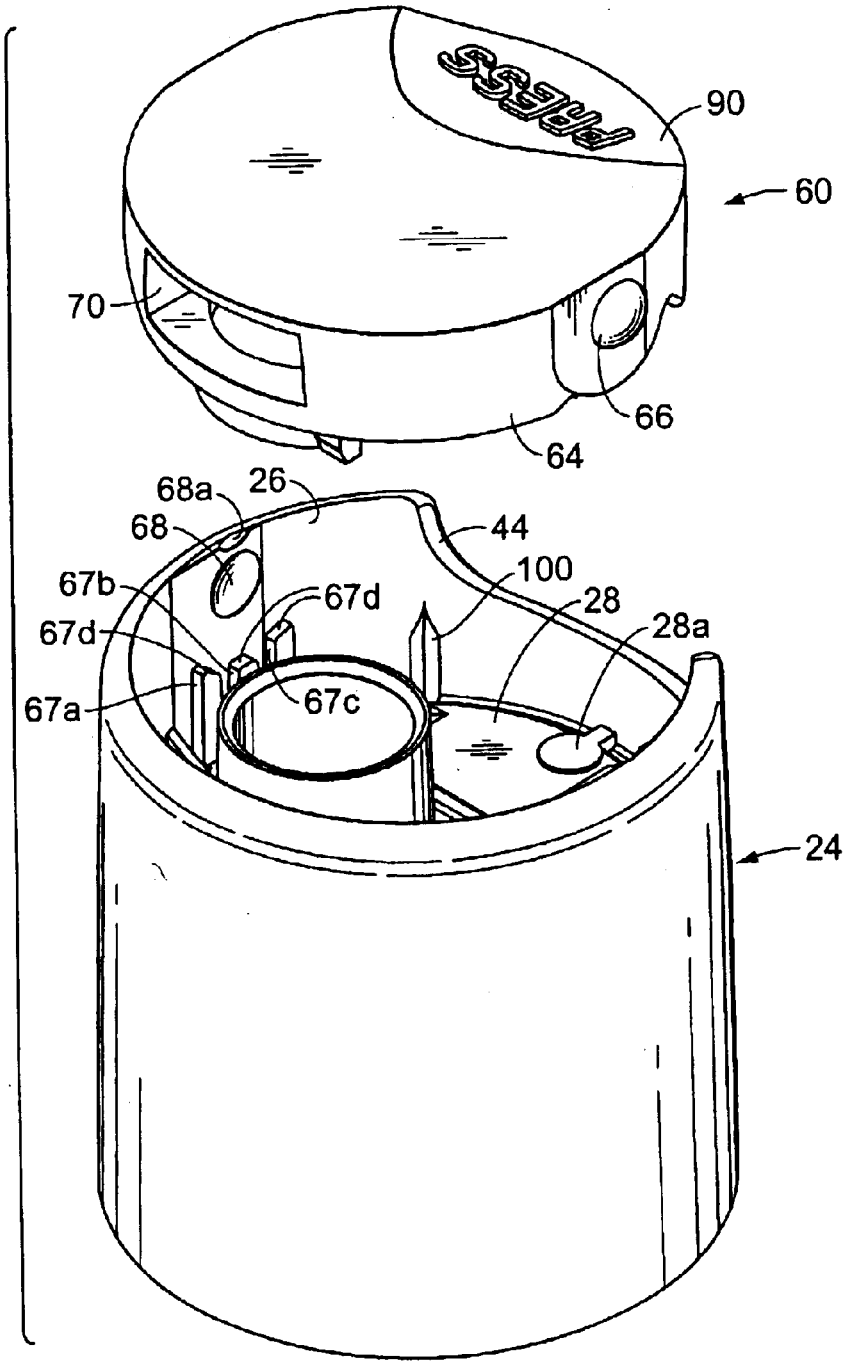
FIG. 3 is an exploded perspective view of the components of the closure shown in FIG. 1, and the components include the closure body for extending from the container and the closure actuator which is designed to be mounted to the closure body.
Figure 7:
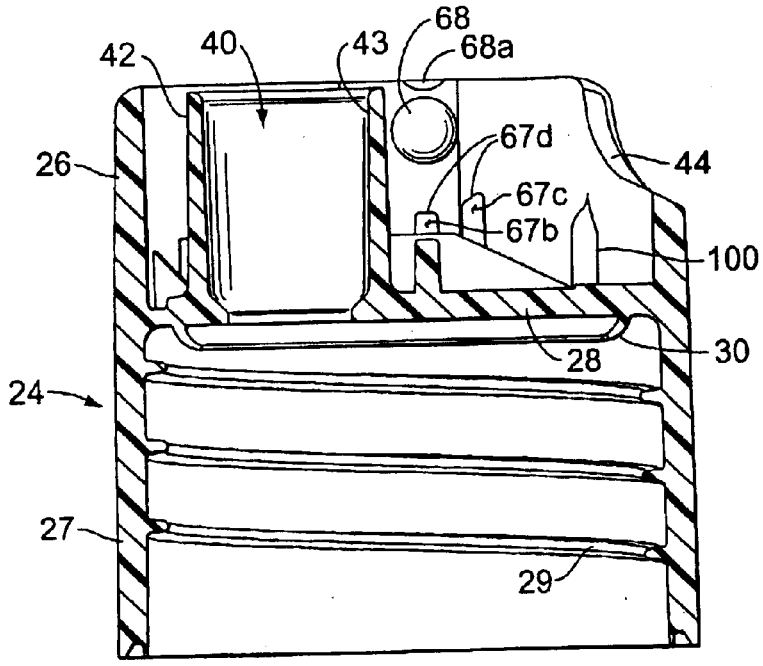
FIG. 7 is a cross-sectional view taken generally along the plane 7—7 of FIG. 6.
Figure 10:
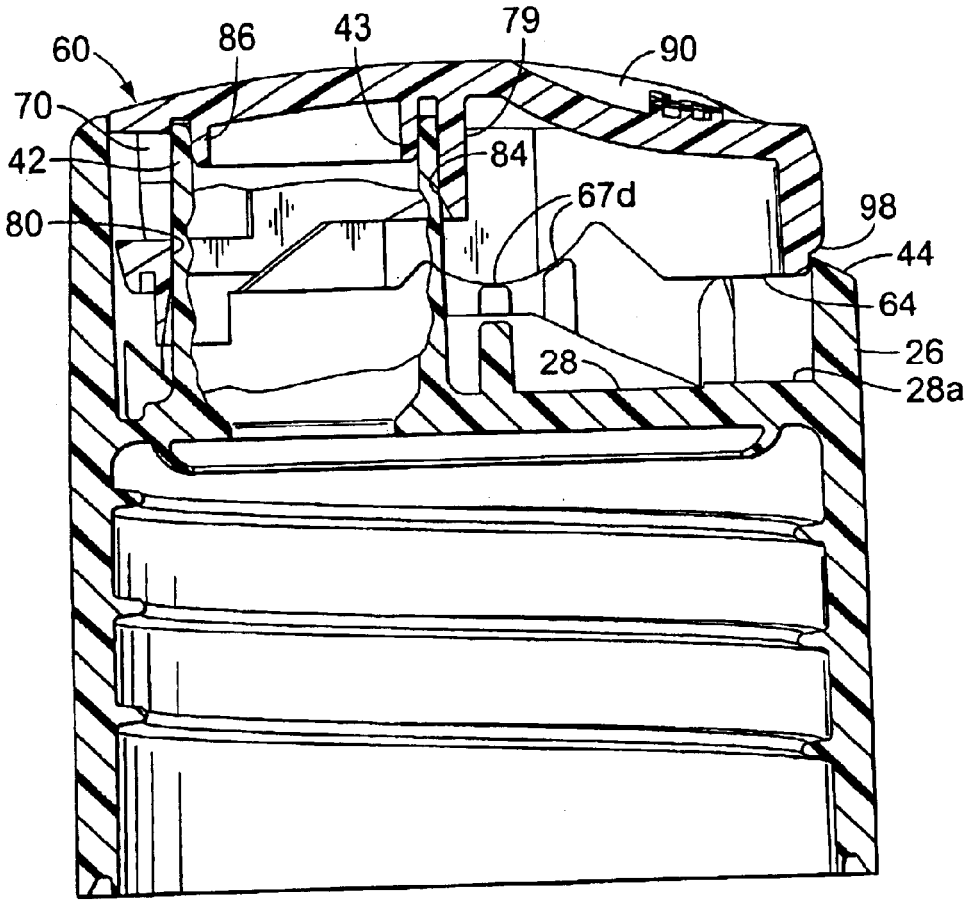
FIG. 10 is a cross-sectional view taken generally along the plane 10$^{-10}$ in FIG. 1.

The closure 20 includes a closure base or body 24, (FIG. 3) for securement to the container. As seen in FIG. 7, the body 24 includes a generally annular, upper wall 26 and a generally annular, lower wall 27. A generally transverse closure wall or deck 28 extends across the body 24 between the upper wall 26 and lower wall 27. The rear portion of the deck 28 is reinforced by a circular boss 28*a* (FIGS. 3 and 10).

The lower, annular wall 27 of the closure body 24 is adapted to engage the outer periphery of the top of the container neck (not illustrated) around the container mouth, as with threads 29. Other suitable engaging means (e.g., snap-fit grooves or beads) may be provided to secure the closure body 24 to mating features on the container. Alternatively, in some applications, the closure body 24 could be non-releasably attached to, or even formed unitarily with, the container (not illustrated).

An annular "crab's claw" type of seal 30 (FIG. 7) may be provided for engaging an interior edge of the container neck at the container mouth to effect a tight seal. Other known seals, such as a "plug" seal, can also be used instead of the plug seal 30.

The closure body 24 includes a discharge passage 40 (FIG. 7) through the deck 28 In the preferred embodiment, the passage 40 (FIG. 7) is defined by a discharge tube 42 projecting upwardly from the deck 28 and having a discharge aperture 43 at the upper end of the tube 42. The discharge aperture 43 may be defined by a slightly convex sealing bead (not illustrated) around the inner periphery of the upper end of the tube 42. The tube 42 accommodates flow of a fluid product through the deck 28 from the container interior at the lower end of the tube 42.

As shown in FIGS. 3 and 7, the annular, upper wall 26 of the closure body 24 extends upwardly above, and around, the deck 28. A rear portion of the wall 26 above the deck 28 defines a notch, finger well, or finger recess area 44 at the top of the wall 26.

The closure body 24 receives a generally disc-like nozzle assembly or actuator 60 (FIGS. 1–3). The actuator 60 includes a generally transverse top wall 62 and a peripheral skirt or flange 64 (FIGS. 2–5). At each of two diametrically opposed portions of the flange 64, there is a projecting, hemispherical protuberance or pivot member 66 (FIGS. 3 and 5).

The pivot members 66 cooperate with the closure body upper wall 26 to mount the actuator 60 for pivoting movement within the closure body 24. To this end, the inner surface of the closure body wall 26 defines two hemispherical recesses 68 (one shown in FIG. 3) for each mating with one of the pivot members 66, to provide a snap-action engagement of each pivot member 66 and respective recess 68.

Also, the body 24 includes a group of three, spaced-apart side columns 67*a*, 67*b*, 67*c* on each side, adjacent the recess 68. Each column has a top surface 67*d* (which may be slightly concave upward). The top surfaces 67*d* of the columns may be characterized as defining a support surface or surfaces.

Figure 4:
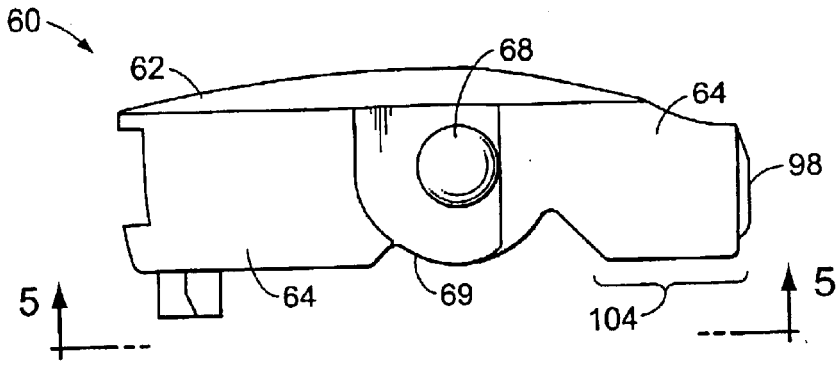
FIG. 4 is a side elevational view of the actuator of the closure shown in FIG. 3.
Figure 5:
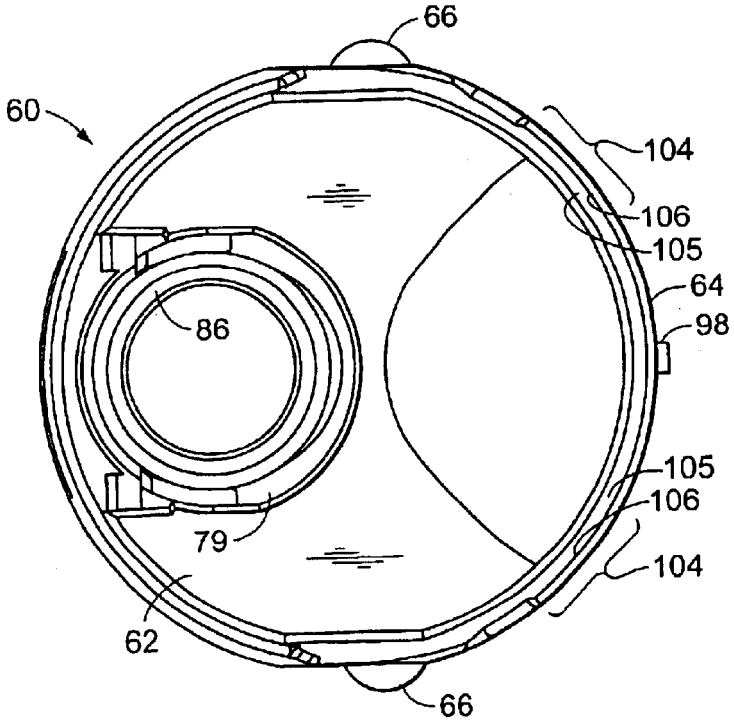
FIG. 5 is a bottom view of the actuator shown in FIG. 4 taken along the plane 5—5 in FIG. 4.

The actuator 60 includes side cams 69 which slide on the top surfaces 67*d* (FIGS. 3 and 4). The surfaces 67*d* support the actuator 60 during the pivoting movement of the actuator 60 about a tilting axis T (FIG. 6) defined by the receiving recesses 68 which receive the actuator pivot members 66.

The top edge of the wall 26, above each recess 68, may be provided with a chamfer 68*a* (FIGS. 3 and 7) for facilitating assembly of the closure body 24 and actuator 60. After the body 24 and actuator 60 have been assembled, the actuator pivot members 66 and body recesses 68 function as mounting means for the actuator 60 so that the actuator 60 can be pivoted or tilted about the tilting axis T (by pushing downwardly on the rear portion of the actuator 60) until the forward end of the actuator 60 is exposed above the closure body wall 26 as illustrated in FIGS. 12 and 11.

The actuator 60 includes a structure on the bottom surface of the top wall 62 which functions—depending upon the orientation of the actuator 60—to either permit dispensing of flowable material from the body discharge tube 42 or occlude the tube passage 40 so as to prevent flow out of the discharge tube 42. In particular, the actuator 60 includes a forwardly extending nozzle or channel 70 (FIG. 2) which merges with, and opens into, a stepped, cylindrical sealing wall 79 (FIGS. 3, 6, 7 and 12).

Figure 11:
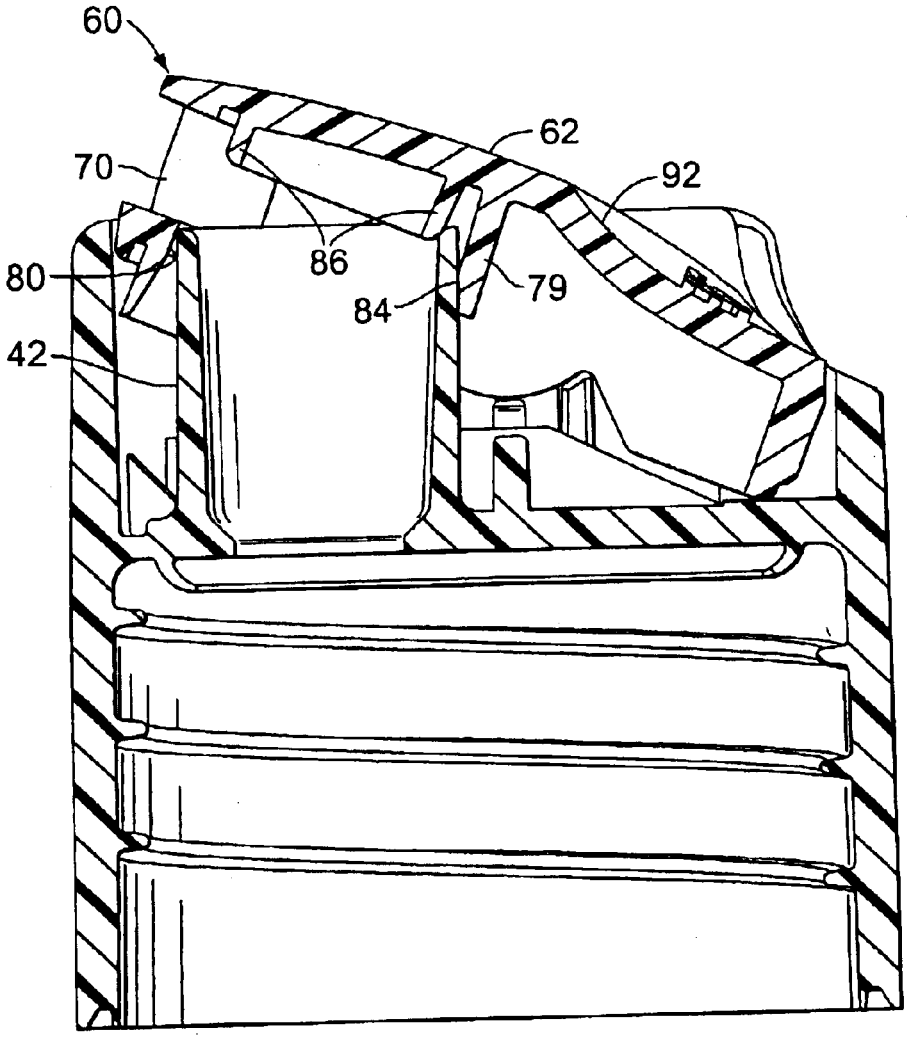
FIG. 11 is a cross-sectional view taken generally along the plane 11—11 in FIG. 2.
Figure 12:
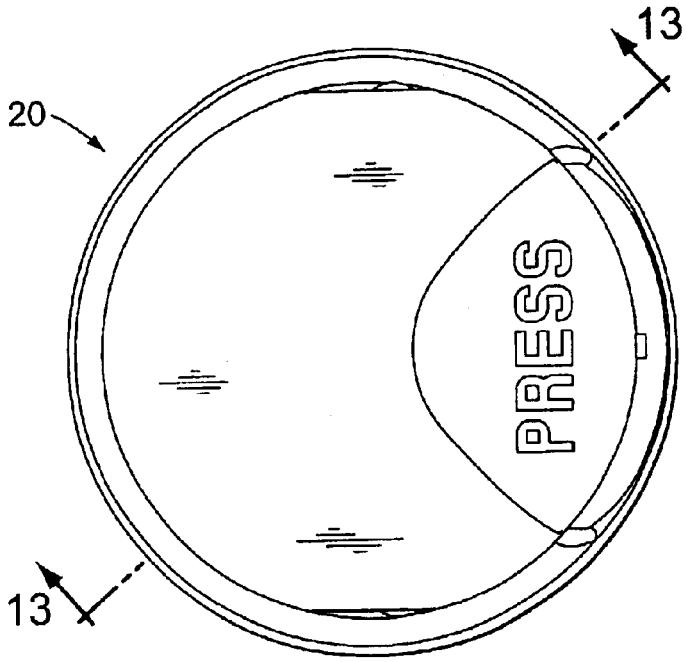
FIG. 12 is a top plan view of the closure shown in FIG. 1.
Figure 13:
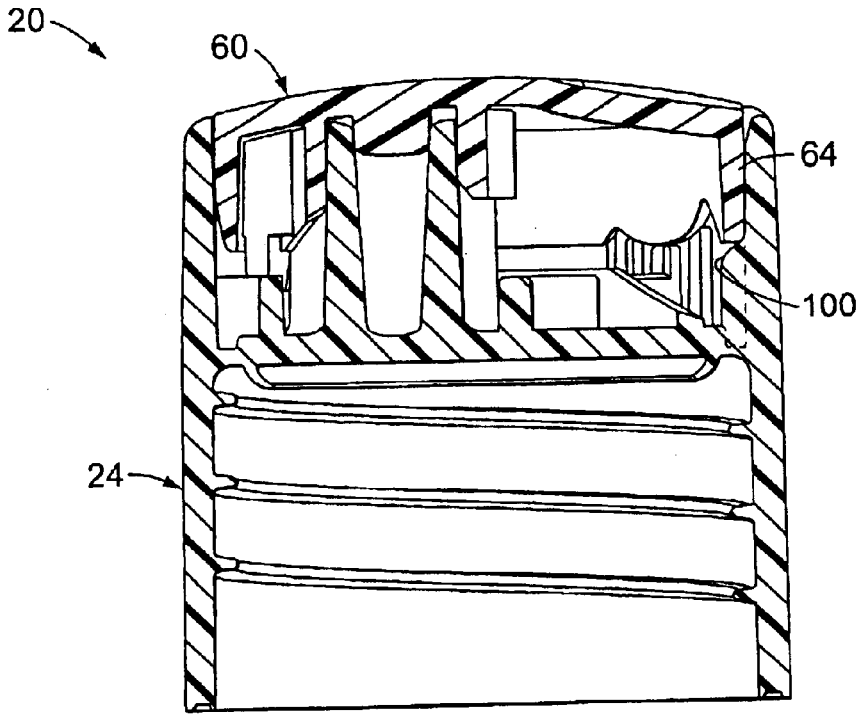
FIG. 13 is a cross-sectional view taken generally along the plane 13—13 in FIG. 12.

As shown in FIG. 10, the wall 79 surrounds and seals the periphery of the discharge tube 42 when the actuator 60 is in the closed position as illustrated in FIG. 10 as well as when the actuator 60 is in the open position as illustrated in FIG. 11. In particular, as shown in FIGS. 10 and 11, the wall 79 forms a seal around the outer periphery of the discharge tube 42 as indicated by reference number 80 at the front of the tube 42 and as indicated by the reference numeral 84 at the rear of the tube 42.

Preferably, an internal sealing plug 86 (FIGS. 5, 10, and 11) projects downwardly from the bottom of the actuator top wall 62. The sealing plug 86 has a generally annular configuration and is adapted to enter into the discharge aperture 43 at the top of the discharge tube 42 to sealingly occlude the tube discharge passage when the actuator 60 is in the closed position as illustrated in FIG. 10.

On the other hand, when the rear of the actuator 60 is pushed down to tilt the actuator to the dispensing position, as illustrated in FIGS. 2 and 11, the front portion of the sealing plug 86 is tilted away from the top of the discharge tube 42 to permit flow of the material out of the discharge aperture at the top of the tube 42 and through the dispensing nozzle 70. When the actuator 60 is tilted completely to the full open dispensing position as illustrated in FIG. 11, the actuator wall 79 still continues to seal the outer periphery of the upper end of the discharge tube 42 so that the container contents, while being dispensed into the nozzle 70, cannot leak out around the exterior surface of the discharge tube 42 below the actuator 60.

The actuator 60 can be pivoted to the open position by applying a downwardly directed force at a location on the top of the actuator 60. To this end, a rear portion of the actuator top wall 62 is recessed within a concave surface or finger well 90 (FIGS. 1, 3, and 5) for receiving the end of a thumb or finger.

A lug 98 (FIGS. 4, 5, and 10) projects rearwardly from the outer, vertical surface of the actuator peripheral flange 64 at the rear of the actuator 60. As illustrated in FIG. 10, the closure body cylindrical, upper wall 26, at the recess 44, defines an edge which underlies the actuator lug 98 when the actuator 60 is closed. When the actuator 60 is forcibly tilted to the dispensing position (FIG. 11), the lug 98 temporarily and resiliently (i.e., without permanent deformation) displaces the adjacent portion of the closure body wall 26 rearwardly to allow the actuator 60 to carry the lug 98 downwardly and inwardly past the wall 26.

The lug 98 serves to provide a resilient catch for the actuator 60 in the closed position which must be overcome by a slight force as the actuator 60 is being pivoted to the open position. The actuator lug 98 clears the closure body wall 26 when the actuator 60 is completely open (FIG. 11). The actuator 60 can be returned to the closed position by pushing down on the front part of the actuator. The actuator flange 64 and/or the closure body wall 26 at the finger recess 44 are sufficiently resilient (i.e., non-permanently deformable) to permit the lug 98 to move upwardly past, and snap above, the wall 26 when the actuator returns to its closed condition (FIG. 10).

In accordance with the present invention, a permanently, plastically deformable structure is provided to prevent accidental, first time movement of the actuator 60 to the open, dispensing orientation shown in FIG. 11. This provides a closure which is resistant to inadvertent actuation during capping processes, during shipping, and during handling, prior to a first use by a consumer.

Figure 6:
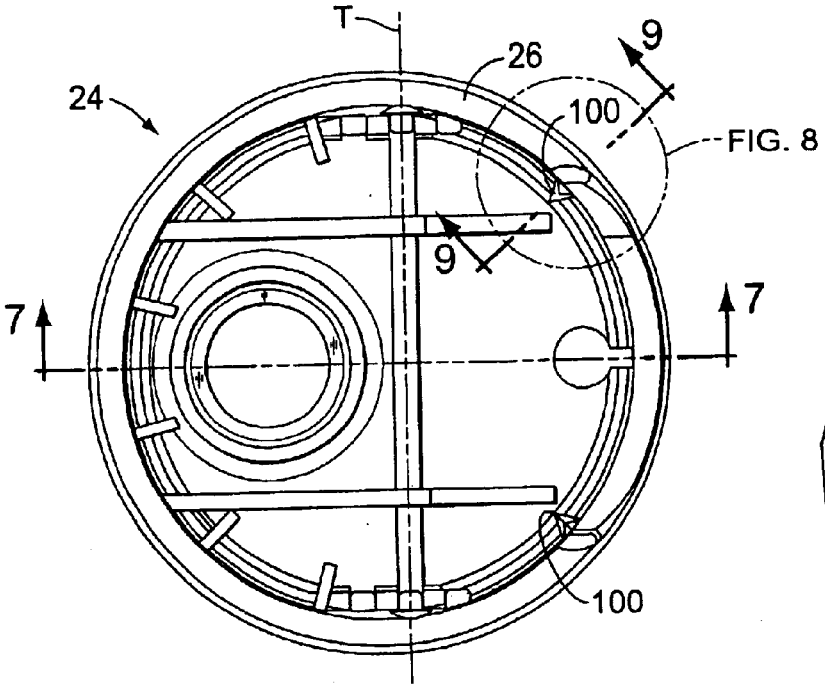
FIG. 6 is a top plan view of the closure body shown in FIG. 3.
Figure 8:
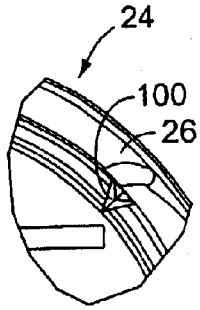
FIG. 8 is an enlarged, fragmentary plan view of the portion of the closure body contained within the circle shown in FIG. 6.
Figure 9:
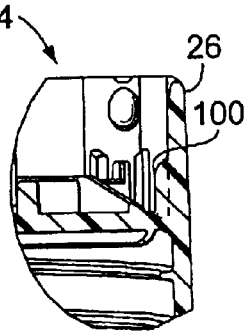
FIG. 9 is an enlarged, fragmentary, cross-sectional view taken generally along the plane 9—9 in FIG. 6.

As can be seen in FIG. 6, the closure body 24 includes two interference members 100. In an alternate embodiment (not illustrated), the closure body 24 may have only one engaging member 100 or may have more than two engaging members 100. The interference members 100 are spaced apart, and each interference member 100 extends along, and projects radially inwardly from, the closure body annular wall 26. As can be seen in FIGS. 3, 6, 7, 8, and 9, the upper end of each engaging member 100 has a wedge shape with a downwardly slanting, somewhat sharp edge. Each engaging member 100 has a generally uniform, triangular transverse cross section along its vertical length or height below the slanted wedge shaped top end.

Figure 14:
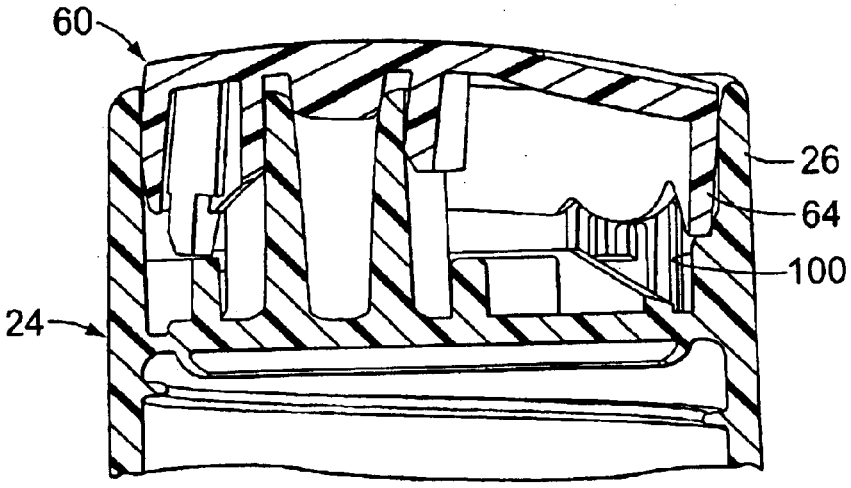
FIG. 14 is a fragmentary, cross-sectional view similar to FIG. 13, but FIG. 14 shows the actuator being tilted away from the closed, non-dispensing position toward the open dispensing position.
Figure 15:
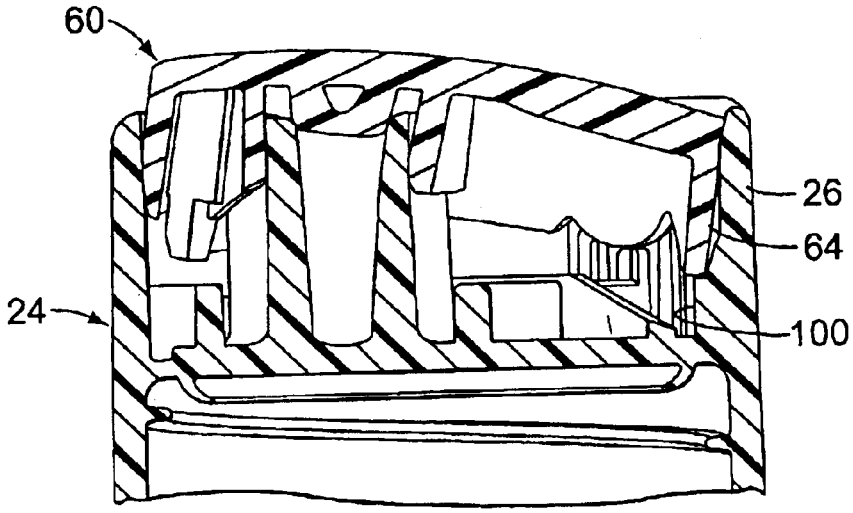
FIG. 15 is a fragmentary, cross-sectional view similar to FIG. 14, but FIG. 15 shows the actuator being tilted further away from the closed, non-dispensing position toward the open dispensing position.
Figure 16:
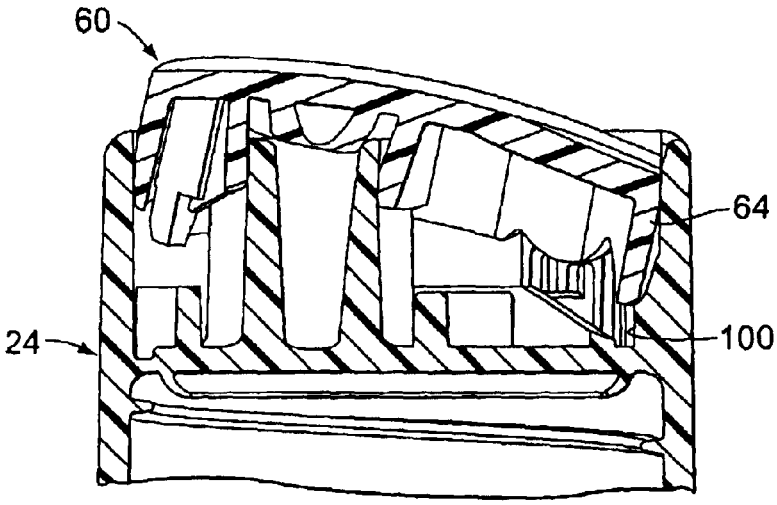
FIG. 16 is a view similar to FIG. 15, but FIG. 16 shows the actuator tilted even further toward the open dispensing position.

The actuator skirt or flange 64 defines an outwardly directed engagable surface, at least in the peripheral area of the flange 64 designated by the brackets 104 in FIG. 5, and the engagable surface 104 is adapted for engaging, or being engaged by, an adjacent interference member 100 when the actuator 60 is mounted in the closure body 24 and when the rear portion of the actuator 60 is tilted downwardly as shown sequentially in FIGS. 14, 15, and 16.

In the preferred embodiment illustrated in FIGS. 1–17, the engaging surface or region 104 of the actuator flange 64 includes (1) the actuator flange bottom edge 105 (FIG. 5), (2) the actuator flange downwardly facing, annular bottom surface 106 (FIG. 5), and (3) the vertical, curved, side surface of the actuator flange 64 in the region of the bracket 104 (FIGS. 4 and 5) that lies adjacent the respective interference member 100 on the closure body 24 when the actuator 60 is properly mounted on the closure body 24 and as the actuator 60 is tilted toward the open, dispensing position as sequentially shown in FIGS. 14–17.

The engagable surfaces 104 on the peripheral portions of the actuator may be formed from the same material and have the same characteristics as other portions of the actuator flange 64 outside of the regions or surfaces 104. Typically, and in a preferred form of the invention, the actuator 60 is molded from a suitable thermoplastic material so that all exterior surfaces of the actuator 60, including the exterior surfaces of the side and bottom of the actuator flange 64, have the same characteristics with respect to surface finish, hardness, modulus of elasticity, ultimate strength, rupture stress, etc.

In alternate embodiments (not illustrated), it may be desirable to provide an actuator 60 in which the engagable surfaces or regions 104 on the actuator flange 64 (FIGS. 4 and 5) differ from the rest of the actuator 60 with respect to such characteristics. Such an alternate embodiment of an actuator may include a different material insert member or members in the engagable regions identified by the brackets 104 or may be bi-injection molded to produce an actuator in which the regions 104 are molded from a different material than the other portions of the actuator 60.

In the preferred embodiment illustrated in FIGS. 1–17, the actuator 60 is molded from a single material, preferably a thermoplastic material, which may deform only slightly, or not at all, relative to the interference members 100 when the actuator 60 is tilted toward the open, dispensing position. Because the interference members 100 each have a narrow, angled, wedge-shaped configuration defining only a small amount of material that is engaged by the overlying actuator flange 64 as the actuator 60 tilts toward the open position, each interference member 100, or at least the thinner portions thereof, may be readily deformed plastically and permanently by the actuator engagable surfaces 104 during tilting of the actuator 60. Such permanent, plastic deformation is illustrated in FIGS. 15, 16, and 17 wherein the upper portion of one of the interference members 100 is shown sequentially with increasing permanent deformation as the actuator 60 tilts further toward the full, open dispensing position.

Figure 17:
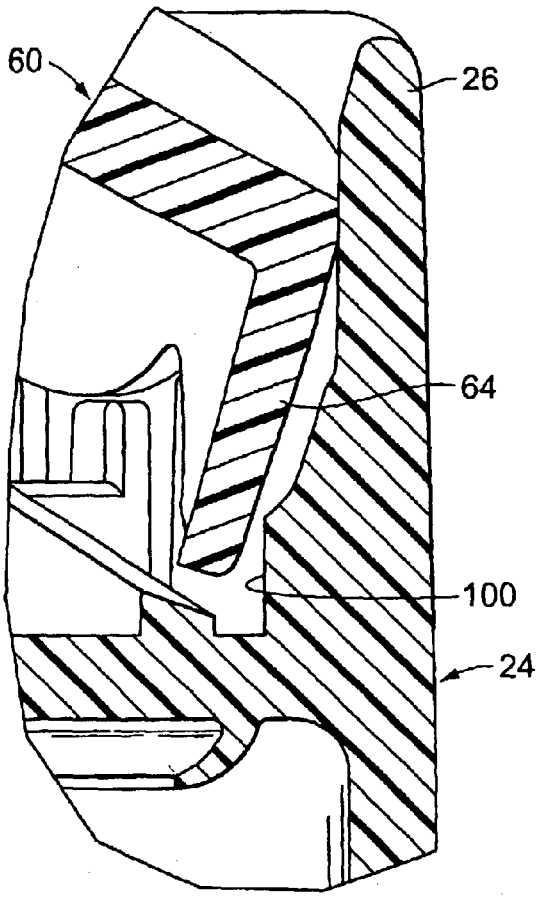
FIG. 17 is a greatly enlarged, fragmentary, cross-sectional view similar to FIG. 16, but FIG. 17 shows the actuator tilted even further toward the open dispensing position.

The actuator flange 64 and closure body interference members 100 can be designed (with respect to specific shapes, thicknesses, materials of construction, and number of interference members 100) so as to establish a minimum resistance force that must be overcome in order to tilt the actuator 60 in an open, dispensing position (FIG. 17).

The closure body interference members 100 may be formed from the same material and have the same characteristics as other portions of the closure body 24. Typically, in a preferred form of the invention, the closure body is molded from a suitable thermoplastic material so that all surfaces of the closure body 24, including the interference members 100, have the same characteristics with respect to surface thickness, hardness, modulus of elasticity, ultimate strength, rupture stress, etc. In alternate embodiments (not illustrated), it may desirable to provide a closure body with interference members 100 that differ from the rest of the closure body 24 with respect to such characteristics. Such an alternate embodiment of a closure body may include an insert of a different material to define the interference members or may be bi-injection molded to produce a closure body 24 in which the interference members 100 are molded from a different material than the rest of the closure body 24.

In an alternate embodiment (not illustrated), each interference member 100 may have a sufficiently sharp configuration and may be composed of sufficiently hard material, relative to the shape and material of the adjacent portion of the actuator flange 64, that the interference members 100 would undergo little and no permanent deformation, and rather, the interference members 100 would instead cause the engagable surface or surfaces 104 of the actuator flange 64 to become scored, distorted, or otherwise plastically deformed in a permanent manner as the actuator 60 is tilted toward the open dispensing position. Appropriate design of the engagable parts of the closure would establish a predetermined minimum force required to effect such permanent deformation to enable the actuator 60 to be tilted to the open, dispensing position.

In another optional embodiment (not illustrated), there may be some permanent, plastic deformation in both the actuator flange 64 and the interference member or members 100.

In any case, the plastic deformation created in either or both the flange of the actuator 60 and the closure body 24 can only occur if at least a predetermined minimum force is applied to the actuator 60 in order to tilt the actuator 60 initially to the open, dispensing position. The parts are designed so that such a predetermined, minimum force is greater than forces that might typically be encountered during capping processes, handling, and shipping—prior to the delivery of the closure and container to the first user.

The user, in order to use the closure for the first time, must initially press the rear top portion of the actuator 60 with a force that is at least equal to, or greater than, the predetermined design resistance force so as to effect permanent deformation of either or both the actuator 60 and closure body 24 to enable the actuator 60 to be tilted to the open, dispensing position.

The plastic deformation that remains permanently in the closure body interference member or members 100 and/or the actuator flange 64 functions as a frictional engagement system when the actuator 60 is tilted back to the closed, non-dispensing position. This is typically accomplished by the user pressing down on the front of the top of the tilted, open actuator 60. The frictional engagement between the open actuator 60 and the closure body 24 is then significantly small so that very little force is required to return the open actuator 60 to the closed, non-dispensing position.

Further, when the user wants to operate the closure a second time or subsequent time by tilting the actuator 60 from the closed position to the open position, the permanent deformation of the closure body 24 and/or actuator 60 provides only a slight frictional resistance, and the force required to open the actuator 60 a second time and subsequent times is considerably less than the force required to initially open the actuator 60 the first time.

The closure components (i.e., the actuator 60 and closure body 24) thus allow for subsequent opening and closing in response to the application of a lower force than was needed to initially open the closure for the very first time.

The permanent deformation of the closure body and/or actuator provides a frictional control means for controlling the force to open and close the container in a consistent and uniform manner after the closure has been initially opened.

The initial opening force required to tilt the actuator to the open, dispensing position for the first time can be established by appropriate design within a relatively narrow range so that the actuator can be initially opened reliably the first time by the user applying the appropriate amount of force which is equal to or greater than the predetermined minimum required initial opening force established by the design.

The design of a closure according to the present invention can be readily incorporated in closures to produce a system with consistent operating characteristics (e.g., the predetermined minimum force required to first open the closure, and the lower force required to subsequently open the closure a second time and additional times). Such characteristics are consistent unit-to-unit with high reliability—even when the closures are produced by efficient, large volume manufacturing techniques.

In the preferred embodiment illustrated in FIGS. 1–17, wherein the actuator also includes the lug 98, the opening and closing forces described above necessarily include forces sufficient to overcome whatever resistance is imposed by the interaction between the actuator lug 98 and the closure body wall 26. Thus, for example, the actual force required to tilt the actuator between the open and closed positions must be great enough to overcome the sum of the resistance forces resulting from (1) the interference between the actuator flange 64 and interference members 100, (2) the resilient, elastic inference deformation between the actuator lug 98 and body sidewall 26, (3) the friction between the actuator and closure body pivot mounting features (e.g., the actuator hemispherical pivot members 66 and the closure body receiving recesses (68)), and (4) any other interference features that may optionally be employed to provide a small retention force on the actuator.

One of ordinary skill in the art will now appreciate that other shapes, contours, etc. may be provided on the closure components to establish a plastic deformation system. In some designs, the interference members 100 may be sufficiently hard compared to the actuator flange engagable surfaces (i.e., the regions 104 in FIGS. 4 and 5), so that the leading, upper edges of the interference members 100 may score the adjacent, engagable surfaces of the actuator 60 during the first actuation of the closure by the user, and this will create a permanent groove in each of the engagable surface regions 104. Each groove may be somewhat V-shaped. During subsequent actuation of the actuator 60, the interference members 100 will be received in the V-shaped grooves with only a small amount of frictional engagement. Owing to this type of relationship, each interference member 100 may be characterized or defined as a "spline." The inventors thus use the term "spline" in this special sense in this specification and in the claims appended hereto.

The permanent, plastic deformation that occurs with the present invention does not lead to a severing or breaking of a piece of material from the closure body 24 or actuator 60. Thus, there is no danger of a loose piece of material being created within the closure during use, and there is no danger that such a loose piece of material could fall into the fluid product being dispensed.

Further, because the design of the present invention does not require the use of a prior art type of upstanding abutment post to prevent premature actuation of the actuator, a special molding insert does not have to be provided to facilitate molding as might otherwise be required or desirable for molding such a prior art upstanding abutment post. Thus, the mold assembly for molding a closure according to the present invention may advantageously be made more simple and less costly.

It will also be appreciated by one of ordinary skill in the art that the location of the interference members 100 and the engagable surfaces 104 may be reversed. That is, the interference members 100 could be provided on the exterior surface of the actuator flange 64, and the engagable surfaces 104 could be defined by the inside peripheral surface of the closure body annular wall 26.

It will also be appreciated that the desired force to initially open the actuator for the first time, and the lower force required to subsequently open the actuator the second time and subsequent times, may be readily adjusted by employing different angles or shapes for defining the exterior portions of the interference members 100 and/or engagable surfaces 104.

The components of the closure of the present invention can be readily molded from thermoplastic materials, such as polypropylene, and easily assembled to provide a complete closure. If desired, the present invention can be incorporated in a closure structure that includes a closure body molded as a unitary part, or extension, of a container. The actuator can be separately molded, and then mounted in such a unitary container/closure body structure. The closure structure, whether it includes a body that is a unitary part of a container or separate therefrom, provides a desirable toggle-action dispensing operation.

It will be readily apparent from the foregoing detailed description of the invention and from the illustrations thereof that numerous variations and modifications may be effected without departing from the true spirit and scope of the novel concepts or principles of this invention.

What is claimed is:

1. A toggle-action dispensing closure structure for an opening to a container wherein said closure structure includes:

a body for extending from said container over said opening and defining a discharge aperture communicating with said opening; and an actuator pivotally mounted about a tilting axis on said body for occluding flow from said container through said discharge aperture when said actuator is in a closed, non-dispensing position and for permitting flow from said container when force is applied to said actuator to tilt said actuator to an open dispensing position whereby said actuator defines an imaginary central plane that is perpendicular to said axis and that passes through said discharge aperture;

one of said body and actuator having at least two spaced-apart splines projecting adjacent a portion of the other of said body and actuator when the actuator is in the closed position, at least each of two of said splines being located offset from said central plane and being on an opposite side of said central plane from the other of said two splines, each said spline being oriented lengthwise to said actuator and closure body when the actuator is in the closed, non-dispensing position so that the length of said central spline is parallel to said plane, each said spline having a transverse cross section that is generally triangular prior to the initial tilting of said actuator to said open dispensing position so as to define a lengthwise converging edge; and the other of said body and actuator having an engagable surface located in registry with said converging edge of each said spline when said actuator is in the closed position for effecting an engagement with said splines as said actuator moves from said closed, non-dispensing position toward said open dispensing position, said engagement initially preventing tilting of said actuator to said open dispensing position in response to said actuator being subjected to a force less than a predetermined force, but said engagement resulting in a permanent, plastic deformation of said splines and/or said engagable surface when said actuator is subjected to at least said predetermined force that tilts said actuator to said open dispensing position for the first time and so that thereafter said actuator can be tilted to said open dispensing position in response to subjecting said actuator to a force less than said predetermined force.

2. The closure structure in accordance with claim 1 in which said closure structure is a dispensing closure that is separate from, but releasably attachable to, said container around said opening.

3. The closure structure in accordance with claim 1, in which said body has said splines projecting generally radially toward said actuator when the actuator is in the closed, non-dispensing position.

4. The closure structure in accordance with claim 1 in which said engagable surface is defined on said actuator; and each said spline is oriented lengthwise on said closure body.

5. The closure structure in accordance with claim 1 in which said actuator has a peripheral flange; and said engagable surface is defined on at least a portion of said actuator peripheral flange.

6. The closure in accordance with claim 1 in which said body includes a peripheral, annular wall, and said splines each project from said annular wall.

* * * * *